United States Patent [19]

Jones et al.

[11] 4,302,997

[45] Dec. 1, 1981

[54] GUARDED TOMATO SLICER

[75] Inventors: Frank W. Jones, Greenville; Joseph Mielnicki, Newark, both of Del.

[73] Assignee: Alco Foodservice Equipment Company, Wilmington, Del.

[21] Appl. No.: 146,354

[22] Filed: May 2, 1980

[51] Int. Cl.[3] ..... B26D 1/03; B26D 7/22; B26D 7/06

[52] U.S. Cl. ..... 83/425.3; 83/425.2; 83/437; 83/431; 83/435; 83/858; 83/544; 83/874

[58] Field of Search ..... 83/437, 431, 425.3, 83/874, 858, 435, 425.2, 856, 544, 733

[56] References Cited

U.S. PATENT DOCUMENTS

| | | | |
|---|---|---|---|
| 2,009,913 | 7/1935 | Bever . | |
| 3,369,582 | 2/1968 | Giangiulio | 83/425.3 |
| 3,605,839 | 9/1971 | Gerson | 83/425.3 |
| 4,144,784 | 3/1979 | Jones | 83/425.3 |
| 4,184,397 | 1/1980 | Jones | 83/874 |
| 4,254,678 | 3/1981 | Steiner et al. | 83/425.3 |

FOREIGN PATENT DOCUMENTS 1085144 1/1955 France .

*Primary Examiner*—Donald R. Schran
*Attorney, Agent, or Firm*—Connolly and Hutz

[57] ABSTRACT

A guarded tomato slicer has a sharp rack of blades mounted substantially diagonally across a table with a loading area disposed between a retracted pusher and the sharp edges of the blades. A swinging vertical gate is mounted in front of the loading area on a vertical pivot adjacent the rack of blades. The gate is resiliently poised in front of the loading area. The gate and pusher are short enough to clear each other when a tomato is pushed into the loading area against and through the swinging gate, which covers the sharp edges of the rack of blades to guard them. The swinging gate has an apertured roof to shield the top of the loading area. As deflectable outer segment of the roof has a projection which provides an outward limit of travel for the swinging gate and is deflectable to permit removal of the swinging gate. The pusher is mounted on a pair of horizontal slide rods connected to the top of the rack having lower extensions which extend downwardly together to provide a support foot.

10 Claims, 6 Drawing Figures

GUARDED TOMATO SLICER

BACKGROUND OF THE INVENTION

Many types of slicers have been suggested which utilize sharp racks of blades and pushers for urging food objects, including tomatoes through the blades. See, for example, Bever, U.S. Pat. No. 2,009,913, French Pat. No. 1,085,144, Giangiulio, U.S. Pat. No. 3,369,582, and Gerson, U.S. Pat. No. 3,605,839. Most of these patents require a tomato to be positioned by hand in front of the sharp edges of a horizontal rack of cutting blades, which are likely to cut or nick the hands of the operator. Tomato slicers with somewhat guarded blades are described in Jones, U.S. Pat. Nos. 4,144,784 and 4,184,397. An object of this invention is to provide a tomato slicer which is efficiently guarded to prevent the hands of the operator from contacting the sharp edges of the cutting blades when inserting a tomato to be sliced.

SUMMARY

In accordance with this invention a swinging gate is vertically pivoted adjacent the rack of blades. It is thus resiliently poised in front of the loading area disposed between the sharp edges of the blades and a retracted pusher. The gate and pusher are short enough to clear each other when the pusher is retracted and the gate is pushed inwardly by an inserted tomato against the sharp edges of the rack of blades to guard them. The swinging gate has an apertured roof plate to shield its top and the roof plate has projections for contacting the front and back of the rack of blades to define the inner and outward limit of travel of the gate. The inner segment of the roof plate is deflectable to clear it from the rack of blades and facilitates removal of the swinging gate. Mounting and removal of the gate is also facilitated by inserting a bearing pin on the table onto a hole in the bottom of the gate. The pusher is mounted on a pair of parallel rods connected to the top of the rack of blades to provide steady support and keep it clear of the path of movement of the tomato and swinging gate. Lower extensions of the parallel pusher rods terminate adjacent the base to provide a support foot.

BRIEF DESCRIPTION OF THE DRAWINGS

Novel features and advantages of the present invention will become apparent to one skilled in the art from a reading of the following description in conjunction with the accompanying drawings wherein similar reference characters refer to similar parts and in which.

DESCRIPTION OF THE PREFERRED EMBODIMENT

Figure 1:
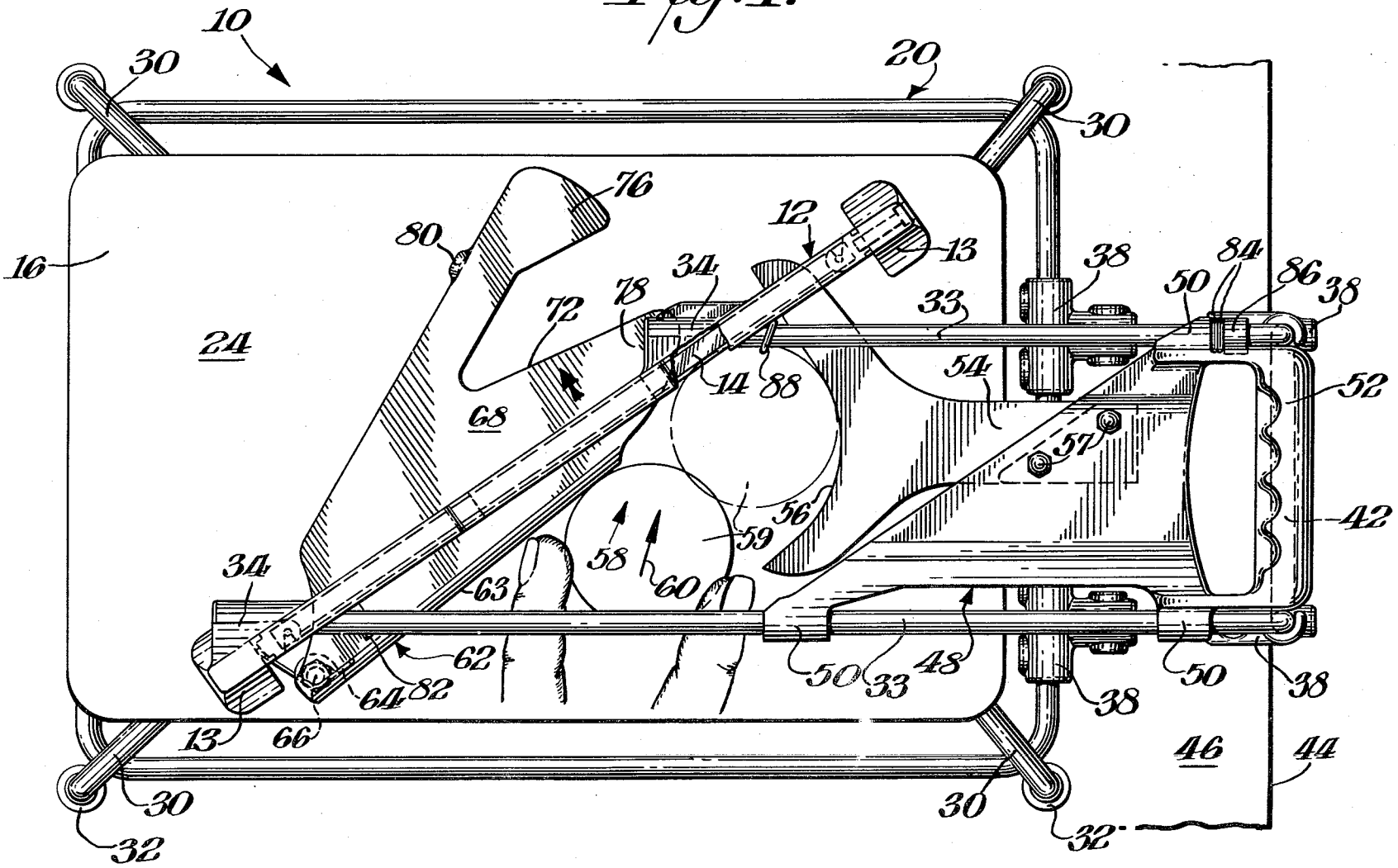
FIG. 1 is a top plan view of a tomato slicer which is one embodiment of this invention showing a tomato being inserted into the cutting position and swinging blade guard gate deflected inwardly against the cutting blades.
Figure 2:
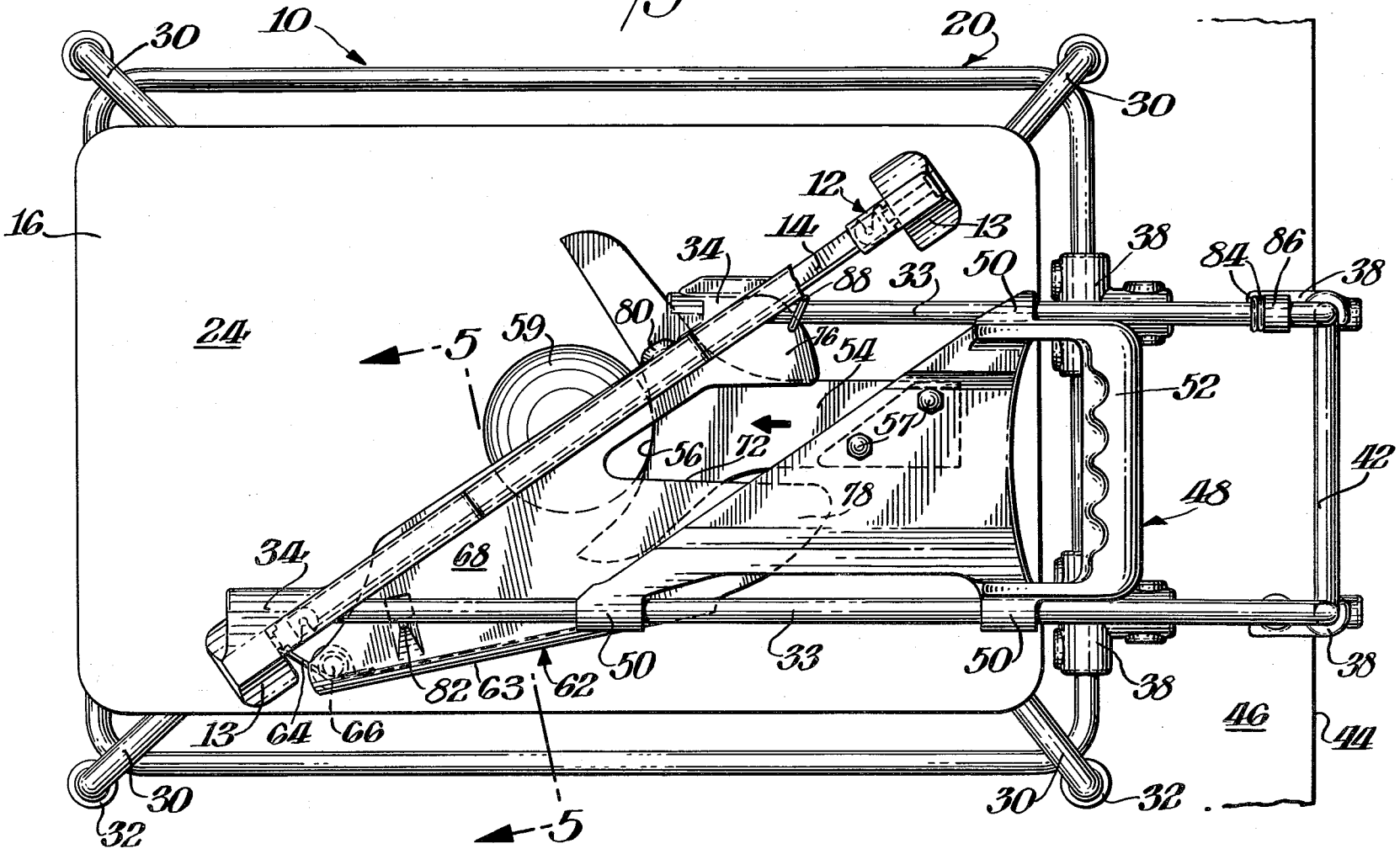
FIG. 2 is a top plan view similar to FIG. 1 showing pusher inserting a tomato through the blades and blade guard swung outwardly into its undeflected position.
Figure 3:
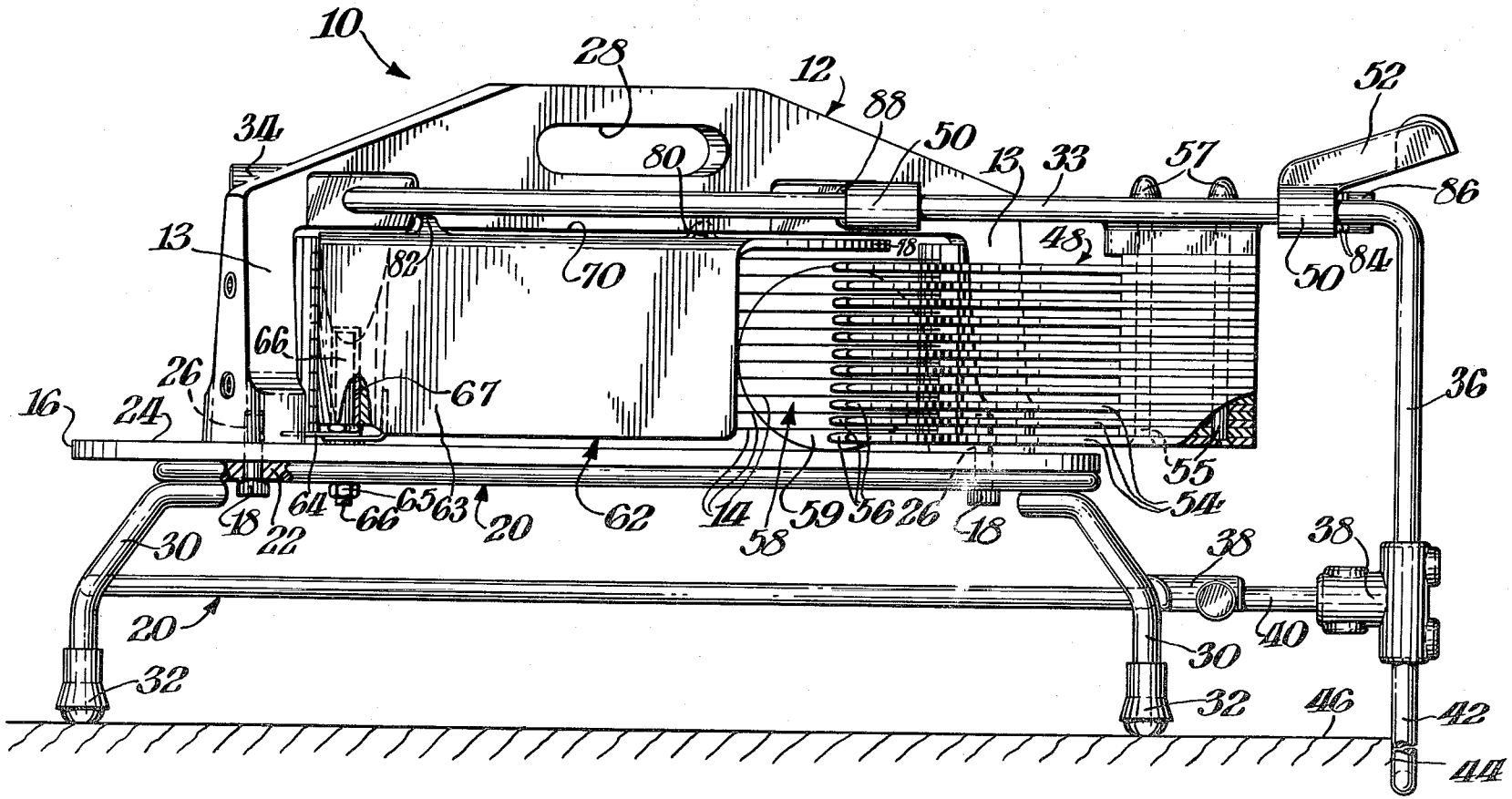
FIG. 3 is a side elevational view of the tomato slicer shown in FIGS. 1 and 2 showing the tomato in the ready for cutting position and blade guard in undeflected position.
Figure 4:
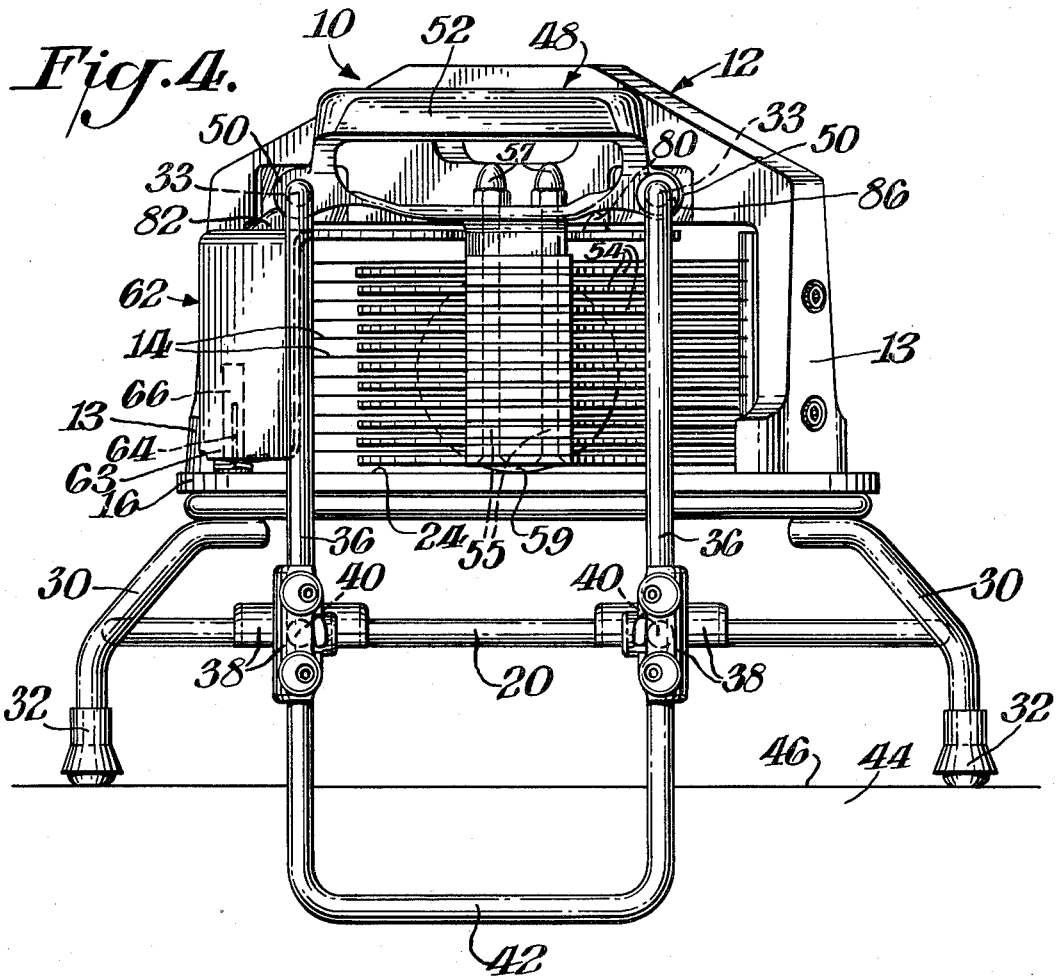
FIG. 4 is a rear elevational view of the tomato slicer shown in FIGS. 1–3.
Figure 5:
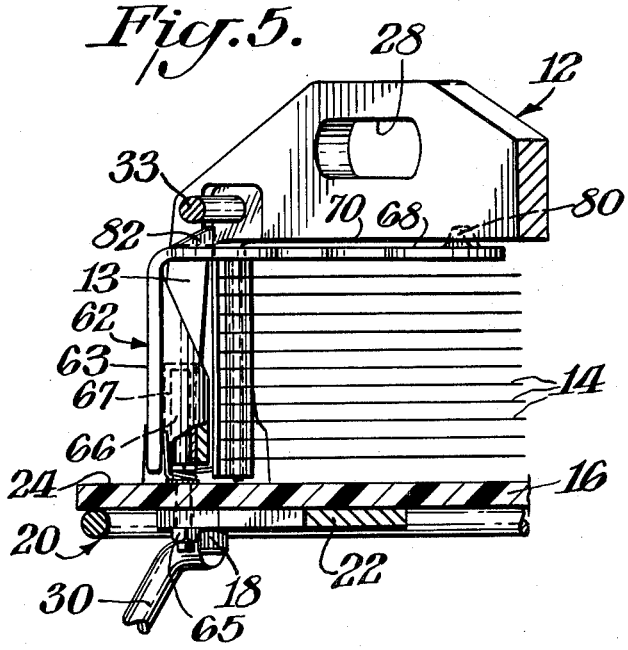
FIG. 5 is a cross-sectional view in elevation taken through FIG. 2 along the line 5—5.
Figure 6:
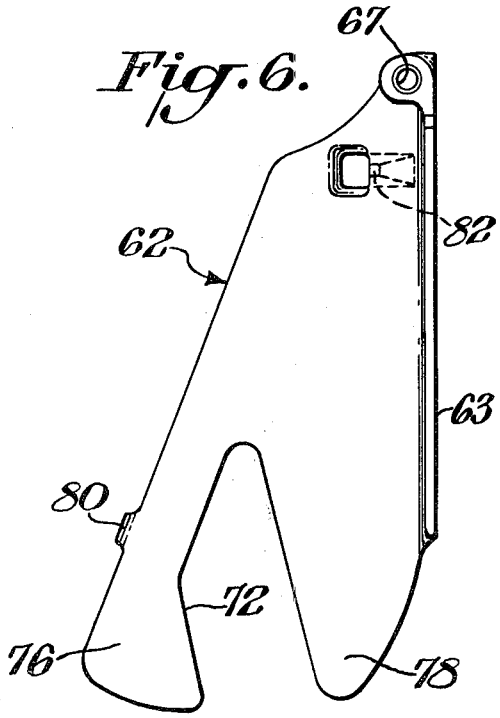
FIG. 6 is a bottom plan view of the blade guard of the tomato slicer shown in FIGS. 1–5.

In FIGS. 1–3 is shown in a tomato slicer 10 incorporating a rack 12 of parallel spaced horizontal blades 14 which are constructed in a manner similar to those described in U.S. Letters Patent No. 3,605,839. The structural portions of the rack are made of a suitable aluminum alloy and the blades are made of a suitable cutting steel, such as high carbon steel or stainless steel. Blades 14 are tensioned in supporting structure 12 in a conventional manner. Rack 12 is mounted, for example, substantially diagonally on table 16 by insertion of cap screws 18 through a portion of table frame 20, namely table top reinforcement bar 22 that extends diagonally aligned under rack 12 and table top 24 as shown in FIG. 5. The table top 24 is made, for example, from a ¼ inch sheet of acrylic plastic. Cap screws 18 are inserted upwardly into bores 26 in the bottom of side extensions 13 of rack 12. Handle 28 at the top of rack 12 facilitate carrying and steadying slicer 10.

Table frame 20 is made, for example, of metal rods or tubes such as noncorrosive metal such as nickel plated brass or stainless steel. Legs 30 are bent outwardly to steady slicer 10. Rubber feet 32 on the bottom of legs 30 prevent it from sliding on a supporting surface.

Parallel guide rods 33 made of the same material as table frame 20 have their forward free ends secured above the blades 14, in sockets 34 provided in blade rack 12, and the guide rods 33 extend rearwardly and bend downwardly as extensions 36, which are joined to table frame 20 by T-shaped connectors 38 and back extensions 40 . As shown in FIGS. 1–4, extensions 36 terminate in a U-shaped foot 42 which foot 42 bears against the edge 44 of supporting surface 46 to prevent movement of the tomato slicer 10 during the slicing operation.

Pusher 48 is mounted on the parallel guide rods by bearings 50 thereby allowing for smooth horizontal back and forward movement of the pusher along the guide rods.

The aft travel of the pusher 48 is adjusted by collar 86 and O-ring shock absorbers 84 and the forward travel of pusher 48 is stopped by rack 12 and O-ring shock absorber 88. Pusher 48 is made of a suitable aluminum alloy similar to or the same as that of the structural portions of blade rack 12. Pusher 48 has a plurality of vertically spaced longitudinal segments 54 joined thereto by bolts 55 and acorn nuts 57. The forward ends of spaced segmented segment 54 terminate in cup-shaped pusher faces 56 constructed and arranged to receive a tomato and urge it through rack of blades 12. The individual segments of pusher 48 are, therefore, constructed and arranged to fit between blades 14 when pusher 48 is pushed toward them.

FIG. 1 shows a loading area 58 substantially between withdrawn pusher 48 and sharp edges of rack of blades 12. A tomato 59 is being inserted in the direction of arrow 60 through and past swinging gate 62 into contact with blades 14. Gate 62 and the withdrawn pusher 48 are short enough to provide clearance between each other for insertion of a tomato into loading area 58.

FIG. 2 shows loading gate 62 in its undeflected position resiliently passed in front of loading area 58 under the action of torsion spring 64 which reacts between the vertical side 63 of swinging gate 62 and vertical side extension 13 of blade rack 12. Gate 62 has vertical bearing hole 67 that rotatably engages over vertical support shaft 66. Support shaft 66 is secured to table 16 by nut 65 and shaft 66 also anchors torsion spring 64. Swinging gate 62 is held downwardly in position by insertion of roof plate 68 through upper slot 70 in rack of blades 12. Aperture 72 in roof plate 68 permits pusher 48 to slide back and forth through it. Aperture 72 subdivides roof plate 68 into outer portion 76 and inner segment 78. Projection 80 extending upwardly from outer portion 76 provides an outward limit of travel for swinging gate 62 and holds it resiliently poised through loading area 58. Roof segment 78 is thin enough to be deflectable to move projection 80 below slot 70 to allow swinging gate 62 to swing outwardly clear of rack 12 and ultimately remove it by lifting it from engagement over vertical support shaft 66. An inward limit of travel for swinging gate 62 is established through projection 82 in the outer front portion of gate 62 which also moves into contact with the edge of black rack 12.

OPERATION

Slicer 10 originally has its swinging gate 62 resiliently poised in front of loading area 58 as shown in FIGS. 2 and 3, and the pusher is withdrawn or retracted into the position shown in FIG. 1. A tomato 59 is pushed against loading gate 62 in the direction of arrow 60. This moves gate 62 back out of the path of tomato 59, which is accordingly moved past it into loading area 58 where it can be operatively contacted by pusher 48 and blades 14. The pusher assembly and gate are short enough to permit free passage of the tomato into the loading area 58. After insertion of tomato 59, pusher 48 is moved forward as shown in FIG. 2 to slice the tomato through rack of blades 12.

We claim:

1. A guarded tomato slicer comprising a flat table, a rack of parallel spaced horizontal blades having sharp edges mounted on the table, a pusher having a parallel array of planar segments for insertion in the spaces between the blades, slide means mounting the pusher on the table for movement back and forth, the slide means being disposed at shallow cutting angle relative to the mid-region of the rack of blades for movement of the pusher through the sharp edges, the pusher being constructed and arranged to urge a tomato through the sharp edges of the rack of blades for slicing it, a loading area disposed substantially between the pusher and the sharp edges of the rack of blades when the pusher is withdrawn away from the blades for receiving the tomato, a swinging gate having a vertical axis of rotation disposed in front of the loading area to shield the sharp edges of the blades as a tomato is inserted into the loading area remote from the pusher end of the swinging gate, resilient stop means reacting against the swinging gate holding it poised outwardly in front of the loading area, and the gate and pusher being short enough to clear each other when the pusher is retracted and a tomato is pushed into the loading area against and through the swinging gate with the gate disposed towards the sharp edges of the rack of blades to guard them.

2. A guarded tomato slicer as set forth in claim 1, wherein the swinging gate has a roof plate for shielding the loading area from above.

3. A guarded tomato slicer as set forth in claim 2, wherein the roof plate has a central aperture to permit the pusher to move forward through it.

4. A guarded tomato slicer as set forth in claim 3, wherein the roof plate has a projection on an outer portion for engaging the rack of blades to provide an inward limit of travel for the swinging gate.

5. A guarded tomato slicer as set forth in claim 4, wherein the roof plate has an inner segment, a lug on the inner segment for defining the outward limit of travel for the swinging gate against the rack of blades, and the segment being deflectable for disengaging the outer stop projection form the rack of blades for removing the swinging gate.

6. A guarded tomato slicer as set forth in claim 5, wherein the gate is mounted on bearing means comprising a bearing pin mounted on the table, and a bearing hole in a lower portion of the front end of the swinging gate whereby the swinging gate is removable from the table when the inner stop lug is deflected clear of the rack of blades.

7. A guarded tomato slicer as set forth in claim 6, wherein the resilient means comprises a torsion spring reacting between the table and the swinging gate.

8. A guarded tomato slicer as set forth in claim 1, wherein the slide means comprises a pair of parallel right angular guide rods having forward and rear ends, the forward ends of the rods being attached to the rack of blades, the rear ends of the rods being mounted on the table, the pusher having a parallel set of pusher bearings engaging the forward parallel rods for firmly supporting the pusher in its back and forth movement without obstructing the path of the tomato and swinging gate.

9. A guarded tomato slicer as set forth in claim 8, wherein the table has a supporting frame and legs, and the rear ends of the pusher rods being vertically disposed and secured to the supporting frame.

10. A guarded tomato slicer as set forth in claim 9, wherein the rear ends of the pusher rods are connected to each other through a bottom horizontal supporting rod which also helps to support the table.

* * * * *